US006827020B2

(12) United States Patent
Fischer et al.

(10) Patent No.: US 6,827,020 B2
(45) Date of Patent: Dec. 7, 2004

(54) SPIN-STABILIZED PROJECTILE HAVING A MULTI-PART GUIDE BAND AND METHOD OF MAKING THE PROJECTILE

(75) Inventors: Siegmar Fischer, Celle (DE); Ernst-Wilhelm Altenau, Dulsburg (DE); Ralf Aumund-Kopp, Bremen (DE); Gunter Sikorski, Dusseldorf (DE)

(73) Assignee: Rheinmetall W & M GmbH, Unterlüss (DE)

( * ) Notice: Subject to any disclaimer, the term of this patent is extended or adjusted under 35 U.S.C. 154(b) by 0 days.

(21) Appl. No.: 10/360,934

(22) Filed: Feb. 10, 2003

(65) Prior Publication Data

US 2003/0145757 A1 Aug. 7, 2003

Related U.S. Application Data

(62) Division of application No. 09/295,399, filed on Apr. 21, 1999, now Pat. No. 6,536,353.

(30) Foreign Application Priority Data

Apr. 24, 1998 (DE) ..... 198 18 411

(51) Int. Cl.[7] ..... F42B 14/02
(52) U.S. Cl. ..... 102/526
(58) Field of Search ..... 102/511, 524–528

(56) References Cited

U.S. PATENT DOCUMENTS 548,884 A * 10/1895 Maxim ..... 102/526
642,762 A * 2/1900 Stubbs et al. ..... 102/526
1,356,840 A 10/1920 Ulrich
2,454,801 A 11/1948 Himmer
4,884,508 A 12/1989 Kruse et al.
5,686,693 A * 11/1997 Jakobsson ..... 102/524
6,536,353 B1 * 3/2003 Fischer et al. ..... 102/526

FOREIGN PATENT DOCUMENTS

| | | | | |
|---|---|---|---|---|
| DE | 308 537 C | | 2/1917 | |
| DE | 37 34 033 A1 | | 4/1989 | |
| DE | 40 00 167 A1 | | 4/1989 | |
| DE | 308537 | * | 2/2000 | ..... 102/524 |
| EP | 46888 | * | 3/1982 | ..... 102/524 |
| FR | 47 430 E | | 5/1937 | |
| FR | 1231601 | * | 9/1960 | ..... 102/524 |
| GB | 526941 A | | 9/1940 | |
| IT | 313405 | * | 7/1934 | ..... 102/524 |

* cited by examiner

*Primary Examiner*—Jack Keith
*Assistant Examiner*—James S. Bergin
(74) *Attorney, Agent, or Firm*—Venable LLP; Stuart I. Smith

(57) ABSTRACT

A spin-stabilized projectile has a projectile body and a guide band being circumferentially mounted on an outer face of the projectile body. The guide band includes a plurality of axially adjoining partial guide bands. One of the partial guide bands is a first partial guide band made of copper, a copper alloy or another soft metal. One of the partial guide bands is a second partial guide band made of soft iron and axially adjoining the first partial guide band. A total axial length of all second partial guide bands is between 5% and 50% of the total axial length of the guide band.

10 Claims, 2 Drawing Sheets

SPIN-STABILIZED PROJECTILE HAVING A MULTI-PART GUIDE BAND AND METHOD OF MAKING THE PROJECTILE

CROSS REFERENCE TO RELATED APPLICATION

This application is a divisional application of allowed U.S. patent application Ser. No. 09/295,399 filed Apr. 21, 1999 now U.S. Pat. No. 6,536,353.

This application claims the priority of German Application No. 198 18 411.5 filed Apr. 24, 1998, which is incorporated herein by reference.

BACKGROUND OF THE INVENTION

This invention relates to a spin-stabilized projectile having a guide band of predetermined length frictionally and/or form-fittingly connected to the projectile body. The invention also relates to a method of making such a spin-stabilized projectile.

In spin-stabilized projectiles the projectiles have guide bands for transferring the torque to the projectile from the rifling of the weapon barrel. The guide bands are frequently made of copper or a copper alloy. The guide bands have such a diameter that as the projectile passes through the barrel, they are pressed into the rifling thereof.

Copper guide bands have the disadvantage that particularly in case of large-caliber weapon systems having barrels of substantial length, the flanks of the guide bands are exposed to an increased wear. Such a guide band wear leads to problems in imparting twist (torque) to the projectile. Further, the sealing of the guide band against the hot propellant gases is no longer securely provided as the projectile passes through the barrel.

It is known to replace copper as the guide band material with soft iron to reduce the guide band wear. Soft iron guide bands, however, have the drawback that the weapon barrel wear is significantly greater than in case of copper guide bands.

Further, German Patent No. 308,537 discloses a spin-stabilized projectile whose guide band is composed of two partial guide bands arranged in series as viewed along the longitudinal axis of the projectile. The first partial guide band which is closer to the rearward terminus of the projectile is made of soft iron and extends over the preponderant length portion of the guide band. The second partial guide band is an axially narrow annulus made of copper or another soft metal. As the guide band penetrates into the weapon rifling, the copper ring causes a thin copper coating to be deposited on the partial, soft iron guide band. Thus, the copper ring functions as a lubricant and therefore counteracts a premature wear of the weapon barrel.

It is a disadvantage of the above-discussed known projectiles having two-part guide bands that particularly upon firing of large caliber projectiles from long weapon barrels, the weapon barrel is nevertheless frequently damaged because of the relatively long partial, soft iron guide band.

SUMMARY OF THE INVENTION

It is an object of the invention to provide a spin-stabilized projectile and a method of making the same, wherein the barrel wear is comparable to that caused by conventional guide bands made of a copper based alloy.

This object and others to become apparent as the specification progresses, are accomplished by the invention, according to which, briefly stated, the spin-stabilized projectile has a projectile body and a guide band being circumferentially mounted on an outer face of the projectile body. The guide band includes a plurality of axially adjoining partial guide bands. One of the partial guide bands is a first partial guide band made of copper, a copper alloy or another soft metal. One of the partial guide bands is a second partial guide band made of soft iron and axially adjoining the first partial guide band. A total axial length of all second partial guide bands is between 5% and 50% of the total axial length of the guide band.

The invention is essentially based on the principle to select the length of the partial guide band made of soft iron possibly short while ensuring that the soft iron guide band securely takes up the radial forces during stress. Tests have surprisingly shown that it is sufficient if the length of the partial soft iron guide band is between 5 and 50% of the length of the entire guide band.

When using 155 mm caliber ammunition fired from weapon barrels having a 52-caliber length, a length of the partial soft iron guide band was found to be sufficient if it is between 20 to 40% of the axial length of the entire guide band.

According to an advantageous embodiment of the invention, the guide band is composed of at least four partial guide bands which are, as viewed axially, alternatingly of soft iron and copper (or a copper alloy) or of another soft metal. Again, the entire length of the soft iron partial guide bands is less than 50% of the length of the entire guide band.

In guide bands which have on their exterior surface grooves for relieving stress of material, it has been found advantageous to provide that the borders of adjoining guide band regions are situated between such grooves.

In the manufacture of the projectiles the partial guide bands are expediently first connected to one another by bonding such as gluing or welding and are only thereafter inserted on and secured to the projectile body.

In a further variant, the axially juxtapositioned guide bands may be mounted in a simple manner on the projectile body.

It has been found to be particularly advantageous to soft-solder or press a low melting point material such as zinc into one or several circumferential grooves of the partial guide band or bands.

DESCRIPTION OF THE PREFERRED EMBODIMENTS

Figure 1:
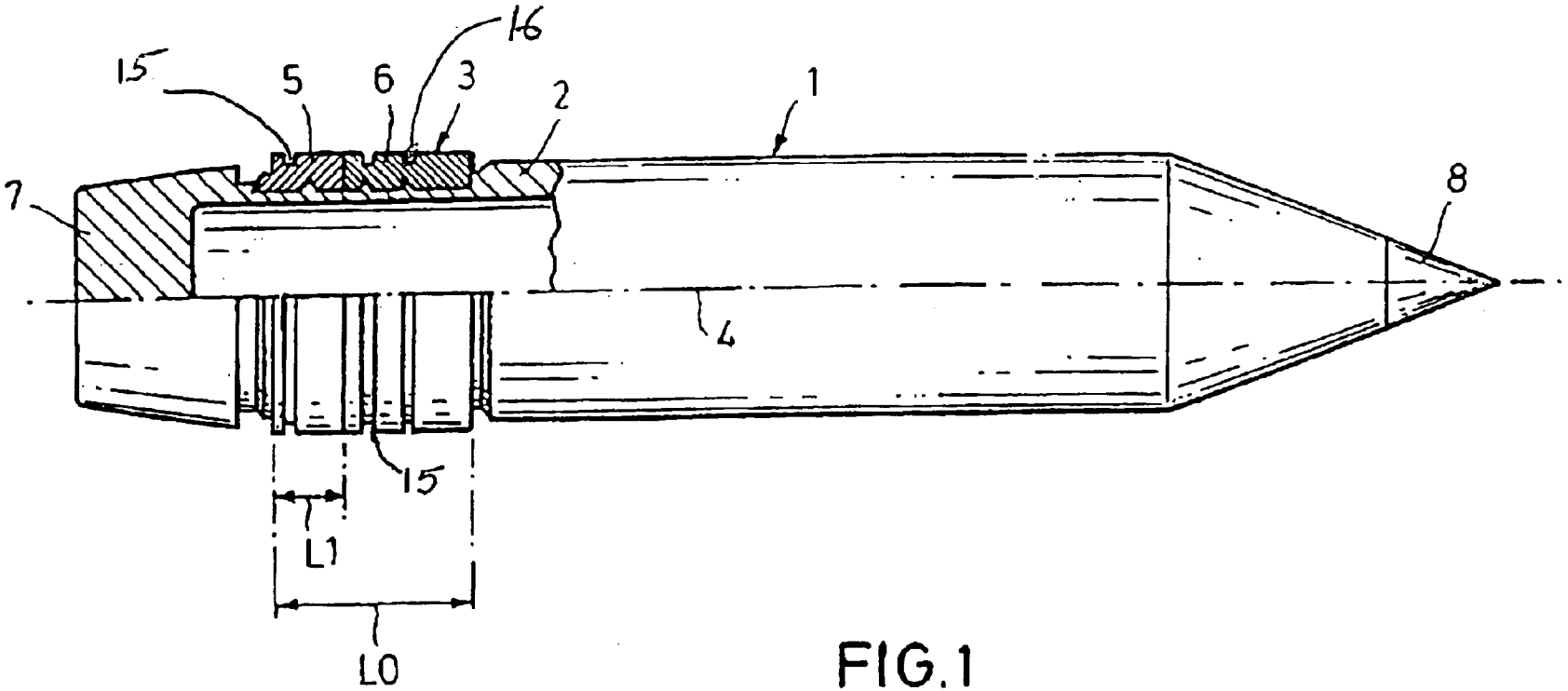
FIG. 1 is an elevational view of a first preferred embodiment of the invention, shown partially in axial section.

FIG. 1 shows an artillery projectile 1 having a projectile body 2 which is coupled in a form-fitting manner with a guide band generally designated at 3. The projectile body 2 has a longitudinal axis 4, a rear terminus (base) 7 and a frontal tip 8. The guide band is composed of two axially adjoining partial guide bands 5 and 6. The partial guide band 5 which is closer to the projectile base 7 than the partial guide band 6 is of soft iron, while partial guide band 6 is made of copper, a copper alloy or another soft metal.

The length LI of the soft-iron partial guide band 5 is approximately 35% of the length L0 of the entire guide band 3. Moreover, the exterior or circumferential surface of the partial guide bands 5 and 6 may be provided with one or more circumferential grooves 15 for relieving stress of the material. In such case, it has been found advantageous to secure, for example, by press fit or soft solder, a relatively low melting-point material 16, e.g., zinc, in at least some of the circumferential grooves 15.

Figure 2:
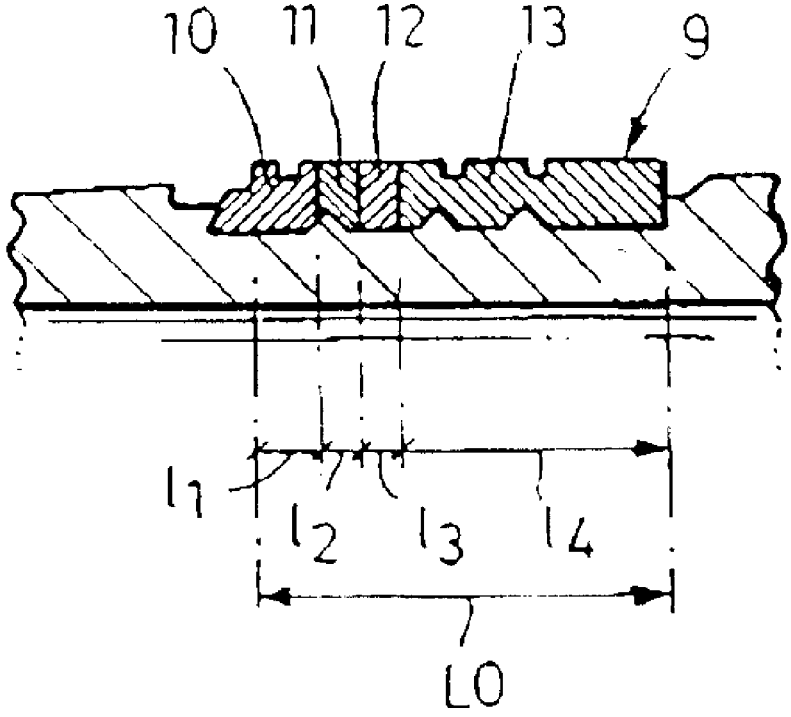
FIGS. 2 and 3 are fragmentary axial sectional views of two further preferred embodiments of the invention.

In the embodiment shown in FIG. 2, the guide band 9 is composed of four partial guide bands 10, 11, 12 and 13 having lengths $l_1$, $l_2$, $l_3$ and $l_4$, respectively. The partial guide bands 10 and 12 are of soft iron whereas the partial guide bands 11, 13 are of copper. The soft iron and copper partial guide bands axially alternate. As to the total length $L1=l_1+l_3$ of the soft iron partial guide bands 10, 12, it again applies that L1 is less than 50% of the length L0 of the guide band 9.

Figure 3:
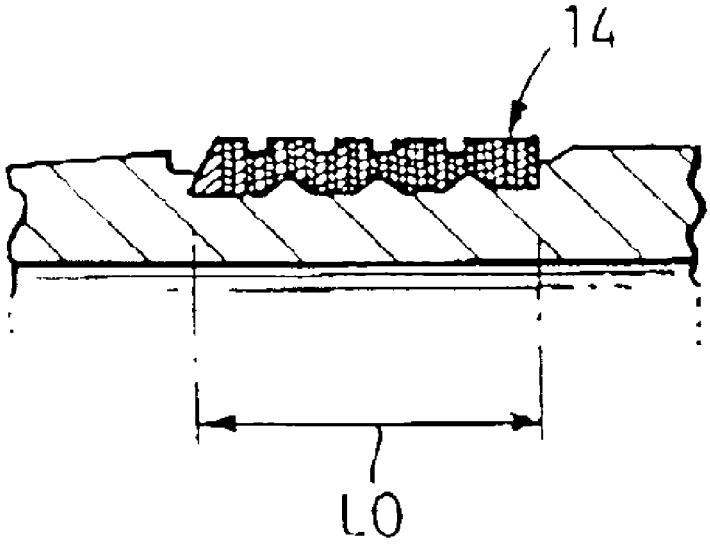

Similar considerations apply to the guide band 14 of FIG. 3, formed of 16 soft iron partial guide bands axially alternating with 16 copper partial guide bands. Such a multilayer guide band arrangement has been found to be advantageous in practice because it ensures a highly satisfactory seal of the guide band for the hot propellant gases when the projectile passes through the barrel and further, an elevated guide band wear is avoided.

The guide band may be secured to the projectile body by a variety of different methods. It has been found to be advantageous in practice to bond the partial guide bands to one another prior to their mounting on the projectile body, for example, by gluing or welding and subsequently to press the entire guide band into a dovetail-shaped guide band groove provided circumferentially on the projectile body.

It will be understood that the above description of the present invention is susceptible to various modifications, changes and adaptations, and the same are intended to be comprehended within the meaning and range of equivalents of the appended claims.

What is claimed is:

1. A spin-stabilized projectile for use with a gun barrel, the spin-stabilized projectile having a longitudinal projectile axis, a projectile body and a guide band being circumferentially mounted on an outer face of said projectile body; said guide band comprising a plurality of axially adjoining partial guide bands; one of said partial guide bands being a first partial guide band made of a material selected from the group consisting of copper and a copper alloy; and one of said partial guide bands being a second partial guide band made of soft iron and axially adjoining said first partial guide band; a total axial length of all second partial guide bands being between 5% and 50% of a total axial length of said guide bands, wherein the total number of said partial guide bands is two, said projectile has a rear terminus and a front terminus, the partial guide band closest to the rear terminus is said second partial guide band and the partial guide band closest to the front terminus is said first partial guide band, and the second partial guide band has a maximum outside diameter that is greater than a maximum inside diameter of the gun barrel taken at an outer most portion of arooves of rifling of the gun barrel.

2. The spin-stabilized projectile as defined in claim 1, wherein a total axial length of all second partial guide bands is between 20% and 40% of the total axial length of said guide band.

3. The spin-stabilized projectile as defined in claim 1, further comprising circumferential grooves provided on said guide band; boundaries between at least some of the adjoining first and second partial guide bands being situated between adjoining said circumferential grooves.

4. The spin-stabilized projectile as defined in claim 3, further comprising a low melting-point material secured in at least some of said circumferential grooves, wherein the low melting point material has a melting point lower than copper and the copper alloy.

5. The spin-stabilized projectile as defined in claim 4, wherein said low melting-point material is zinc.

6. The spin-stabilized projectile as defined in claim 1, wherein the second partial guide band is for providing a propellant gas seal between the projectile and the gun barrel.

7. The spin-stabilized projectile as defined in claim 6, wherein the maximum outside diameter of the second partial guide band is at least as large as a maximum outside diameter of the first partial guide band.

8. The spin-stabilized projectile as defined in claim 1, wherein the second partial guide band has a maximum outside diameter that is at least as large as a maximum outside diameter of the first partial guide band.

9. A spin-stabilized projectile for use with a gun barrel, the spin-stabilized projectile having a longitudinal projectile axis, a projectile body and a guide band being circumferentially mounted on an outer face of said projectile body; said guide band comprising a plurality of axially adjoining partial guide bands; one of said partial guide bands being a first partial guide band made of a material selected from the group consisting of copper and a copper alloy; and one of said partial guide bands being a second partial guide band made of soft iron and axially adjoining said first partial guide band; a total axial length of all second partial guide bands being between 5% and 50% of a total axial length of said guide band, wherein the total number of said partial guide bands is two, said projectile has a rear terminus and a front terminus, the partial guide band closest to the rear terminus is said second partial guide band and the partial guide band closest to the front terminus is said first partial guide band, and the second partial guide band is for providing a propellant gas seal between the projectile and the gun barrel.

10. The spin-stabilized projectile as defined in claim 9, wherein the second partial guide band has a maximum outside diameter that is at least as large as a maximum outside diameter of the first partial guide band.

* * * * *